US006258428B1

(12) United States Patent
Phillips et al.

(10) Patent No.: US 6,258,428 B1
(45) **Date of Patent: *Jul. 10, 2001**

(54) METHOD OF USING AN ENTERTAINMENT PLACEMENT PRODUCT HAVING STORAGE POCKET

(75) Inventors: Richard L. Phillips, West Chester; Michael E. Hetrick, Dayton, both of OH (US)

(73) Assignee: NCR Corporation, Dayton, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/911,785

(22) Filed: Aug. 15, 1997

(51) Int. Cl.[7] ..... B32B 9/06; B32B 31/12

(52) U.S. Cl. ..... 428/42.1; 428/13; 428/41.7; D6/613; D6/615

(58) Field of Search ..... 428/41.7, 42.1, 428/13; D6/613, 615

(56) References Cited

U.S. PATENT DOCUMENTS

| | | | | |
|---|---|---|---|---|
| D. 229,915 | * | 1/1974 | Bradford | D6/616 |
| D. 325,145 | * | 4/1992 | Issac | D6/613 |
| 416,171 | | 12/1889 | Mahoney | 446/97 |
| 3,383,121 | | 5/1968 | Singer | 462/66 |
| 3,750,309 | | 8/1973 | Tovar | 434/382 |
| 4,177,846 | * | 12/1979 | Rountree | 108/90 |
| 4,235,459 | | 11/1980 | Callahan | 283/114 |
| 4,439,941 | | 4/1984 | Halperin | 40/124.1 |
| 4,510,006 | | 4/1985 | Lawson | 156/235 |
| 4,568,108 | | 2/1986 | Simpson | 281/5 |
| 4,627,994 | | 12/1986 | Welsch | 428/41 |
| 4,652,239 | | 3/1987 | Brimberg | 434/80 |
| 4,712,673 | | 12/1987 | Moore | 206/232 |
| 4,778,153 | | 10/1988 | Bachman et al. | 283/101 |
| 4,800,108 | * | 1/1989 | Swartz | 428/43 |
| 4,809,905 | | 3/1989 | Goodman | 229/70 |
| 4,811,951 | | 3/1989 | Dorsey-Zinn et al. | 273/157 |
| 4,944,968 | | 7/1990 | Wagner | 428/13 |
| 4,983,438 | | 1/1991 | Jameson | 428/42 |
| 5,006,191 | | 4/1991 | Schmidt | 156/268 |
| 5,036,472 | | 7/1991 | Buckley et al. | 364/479 |
| 5,096,752 | | 3/1992 | Wagner | 428/13 |
| 5,106,305 | | 4/1992 | Grant | 434/84 |
| 5,129,682 | | 7/1992 | Ashby | 283/81 |
| 5,135,789 | | 8/1992 | Schmidt | 428/42 |
| 5,244,394 | | 9/1993 | Serabian-Musto | 434/263 |
| 5,248,536 | | 9/1993 | Du Katz | 428/40 |
| 5,262,215 | | 11/1993 | Shields | 428/40 |
| 5,269,691 | | 12/1993 | Waldman | 434/429 |
| 5,292,154 | | 3/1994 | Williams | 283/2 |
| 5,377,904 | | 1/1995 | Michlin et al. | 229/70 |
| 5,397,052 | | 3/1995 | Walz | 229/300 |
| 5,507,901 | | 4/1996 | Limina et al. | 156/200 |
| 5,512,612 | | 4/1996 | Brown et al. | 523/218 |
| 5,658,620 | * | 8/1997 | Ross | 428/9 |
| 5,741,561 | * | 4/1998 | Lenkin | 428/13 |

FOREIGN PATENT DOCUMENTS

| | | | |
|---|---|---|---|
| 441900 | | 11/1925 | (DE) . |
| 9315699 | | 2/1994 | (DE) . |
| 0745343 | * | 4/1996 | (EP) . |
| 2090146 | | 7/1982 | (GB) . |

* cited by examiner

*Primary Examiner*—Jill Warden
*Assistant Examiner*—LaToya I. Cross
(74) *Attorney, Agent, or Firm*—Francis L. Conte

(57) ABSTRACT

A placemat product having a built-in storage pocket is provided for customer entertainment. The placemat product provides the multiple functions of a sanitary tabletop placemat or tray liner, an entertainment device to occupy customers and a storage pocket to hold related entertainment items such as crayons, treats, games, children's menus, disposable wipes, small compact toys, promotional reply cards and the like all in one comprehensive, integrated product.

20 Claims, 3 Drawing Sheets

METHOD OF USING AN ENTERTAINMENT PLACEMENT PRODUCT HAVING STORAGE POCKET

RELATED APPLICATION

Ser. No. 08/452,737 entitled "Placemats Having Integrated Adhesive Stickers or Labels" in which Katherine C. Horton and Mark C. Rogers are inventors, filed on May 30, 1995.

BACKGROUND OF THE INVENTION

The present invention relates to a method for using an entertainment and sanitary placemat product having a built-in storage pocket.

Restaurants and other businesses that have a need to occupy and entertain children for unspecified periods of time, need tabletop placemats or tray liners for their patrons' sanitary protection during dining; entertainment products to occupy customers, particularly children; and a way to manage family outings efficiently. The placemats or tray liners must be relatively inexpensive and accommodate quick and easy clean-up.

It is known to provide placemats with liquid impervious pockets for displaying celebrity (such as baseball) cards. However, such pockets are provided on the sanitary portion of the placemat, are formed of a clear, preferably liquid impervious material and are shaped (sized) to hold only the displayed cards. It is also known to provide food such as a fast food meal in a combination food carrier and amusement device having bags to hold the meal itself. However, this carrier/device provides a multi-ply entertainment device with grease resistant bags inside a carrier, making the total package bulky and relatively expensive. Additionally, envelopes have been provided as part of a single unit construction for business forms but they are provided for mailing a business letter or form, not constructed for holding various items related to an entertainment placemat. Additionally, such business forms are not intended for food-related uses, so the construction materials may not meet FDA (Food And Drug Administration) recommendations for items used in the food services industry.

There is a need to provide a placemat product with a built-in storage pocket which customers can use for entertainment purposes while waiting for services and which restaurants and other businesses can provide customized information and store multiple related supply items in one easy to handle comprehensive and integrated product for customer entertainment and enjoyment.

SUMMARY OF THE INVENTION

In accordance with the teachings of the present invention, a placemat product having a built-in storage pocket is provided. The placemat product provides the multiple functions of a sanitary tabletop placemat or tray liner, an entertainment device to occupy customers and a storage pocket to hold related entertainment items such as crayons, treats, games, children's menus, disposable wipes, small compact toys, promotional reply cards and the like all in one comprehensive, integrated product.

It is an important feature of the present invention that the placemat product with a built-in storage pocket allows businesses to add and store multiple related supply items in one easy to handle comprehensive, integrated product for customer entertainment.

Another important feature of the present invention is that the placemat product with a built-in storage pocket is primarily a paper product, requiring relatively inexpensive materials to provide an enjoyable dining product.

Still another important feature of the present invention is that the built-in storage pocket can be sealed shut and then reopened to reveal multiple related entertainment items. The built-in storage pocket can be used as a removable bag for the storage of take-home entertainment material or for the mailing in and registration for promotions, frequent user programs, registrations, contests, clubs, etc.

Yet another important feature is this product's one piece construction. According to the present invention, a single unit product replaces separate placemats, games, crayons, and containers to provide the business with increased operations efficiency, less inventoried items and lower supplies' cost.

Additionally, another important feature is the paper construction that has a singular plane(planographic) design which enables the business to print customized information. The product of the present invention can easily be processed through almost any impact and/or non-impact computer controlled printer to allow the placemat product to be customized to the exact needs of the business on site. The business can add variable data via a standard printer. This data can include information that changes regularly like addresses, phone numbers, menus, logos, promotional information, etc. The integrated product design adds great value in that the business does not have to purchase many individual custom orders every time one of the data elements change. Optionally, customized computer software can be used that supports multiple entertainment themes (games, promotions, puzzles, scenes, etc.), menu generation, in-store promotions, personalization, additional graphics, templates and general print-on-demand capabilities. A business can purchase one generic version in large quantity at lower production costs and then customize the generic version using the business' printer saving time and cost.

An alternative placemat product design provides the integrated pocket as a mail piece for contest entry, club entry, frequent guest entry programs that can all be integrated into the entertainment theme. This alternative design would further provide the user with improved guest service, additional repeat business, customer loyalty and value.

Construction of this product can be adjusted to different combinations of sizes, materials, perforations, die-cuts, to provide utility and value in many different customer systems and applications.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
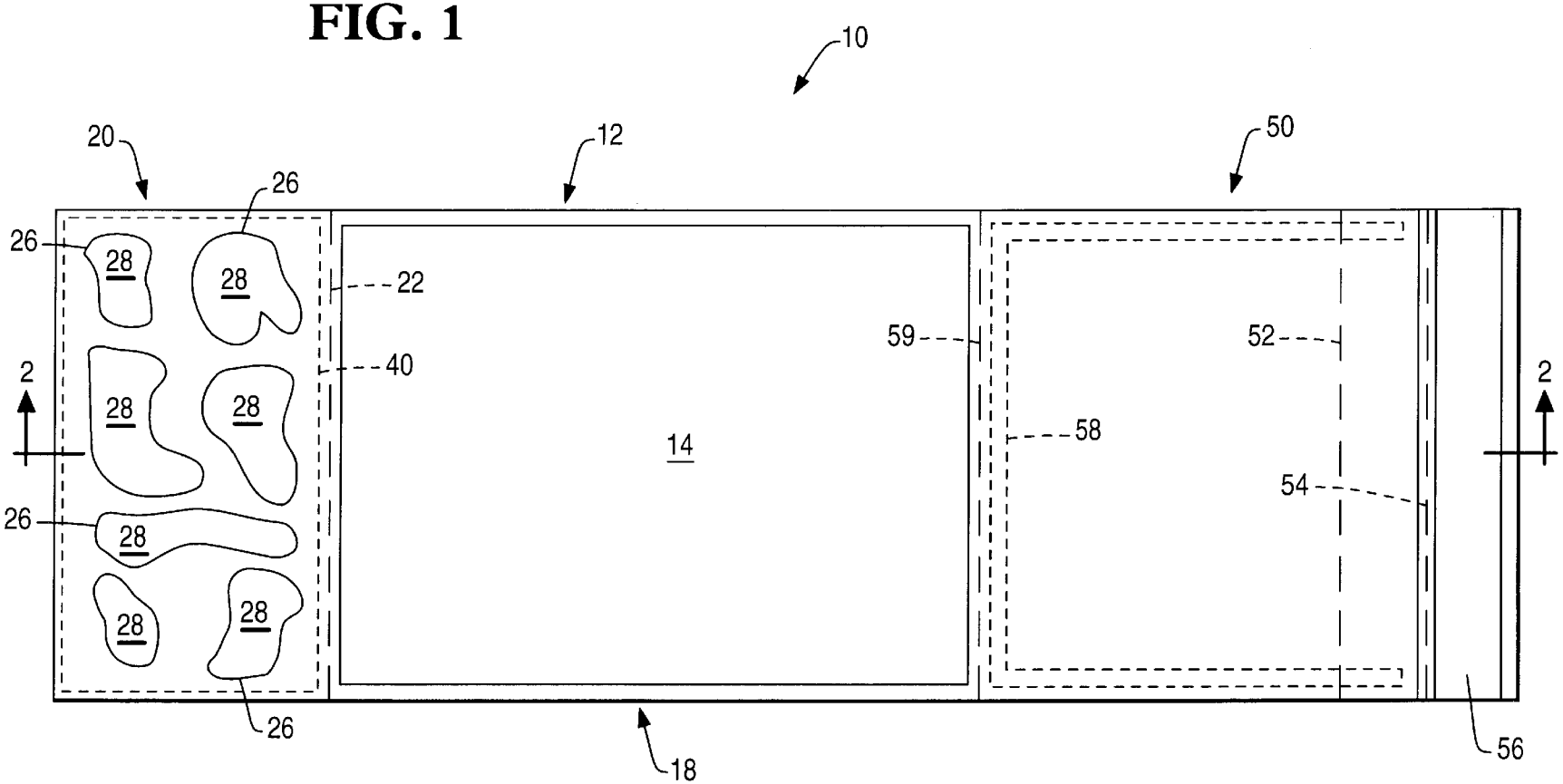
FIG. 1 is a top view of a placemat product having a built-in storage pocket in accordance with the present invention.

Referring now to the drawings, in which like-referenced characters indicate corresponding elements throughout the several views, attention is first drawn to FIG. 1 which shows a top view of a placemat product having a built-in storage pocket in accordance with the present invention. The placemat product 10 includes a sanitary placemat portion 12, a sticker portion 20 and a built-in storage pocket portion 50, preferably formed of two sheets of paper. The sanitary placemat portion 12 includes a preprinted entertainment theme 18 on the front surface 14.

The sticker portion 20 includes a plurality of die-cuts 26 which form stickers 28 with preprinted indicia associated with the preprinted entertainment theme 18 of the sanitary placemat portion 12. The sticker portion 20 may optionally be separated from the sanitary placemat portion 12 by a line of perforations 22. The preprinted indicia on the stickers complete or enhance the preprinted entertainment theme of the sanitary placemat portion to provide entertainment for the user or customer.

The built-in storage pocket portion 50 includes a perforation line 52, a fold line 54 and a remoistenable adhesive or pressure sensitive tape area 56. The built-in storage pocket portion 50 may optionally be separated from the sanitary placemat portion 12 by a line of perforations 59.

Figure 2:
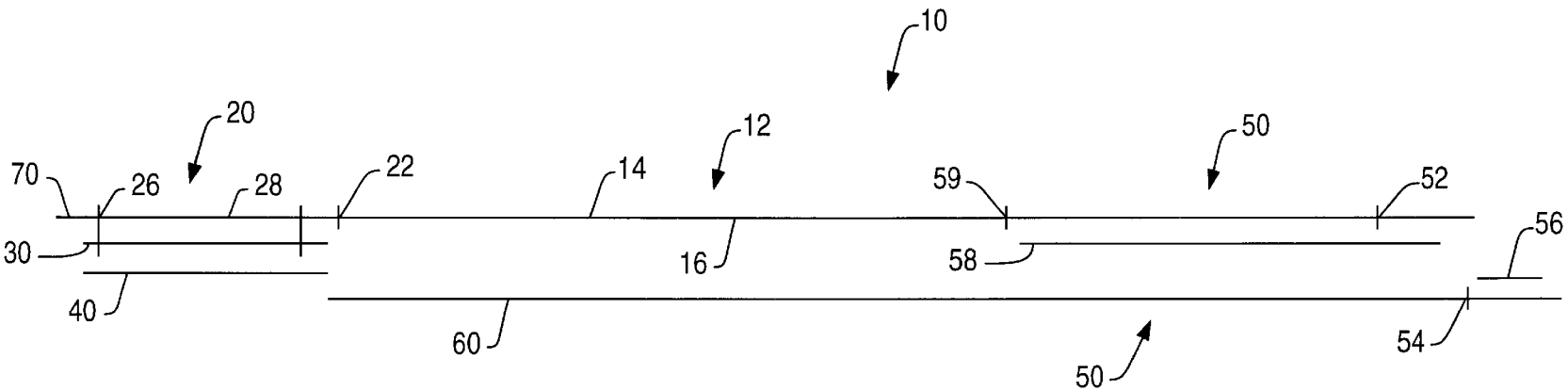
FIG. 2 shows a side view of the placemat product of FIG. 1.

FIG. 2 shows a side view of the placemat product 10 shown in FIG. 1. First single paper ply 70, the longer ply, forms the sanitary placemat portion 12, the sticker portion 20 and the top portion of built-in storage pocket portion 50. Second single paper ply 60 forms the bottom portion of built-in storage pocket portion 50. First single paper ply 70 and second single paper ply 60 may be any type of paper such as laser, copy, bond, chemical carbonless and the like. Obviously, these relative dimensions can be adjusted or reversed if it is desired for the pocket to open toward the opposite sides and/or if different sized stickers, themes or storage pockets are desired.

To form the stickers, first single paper ply 70 has a removable adhesive coating 30 applied on the back 16 in a specifically designed and limited area. Then a silicone coated liner sheet or other release coated liner sheet 40 with a limited predetermined size is applied to the back surface 16 of the first single paper ply 70 over the removable adhesive coating 30. The pre-printed first paper ply 70 is then die-cut 26 with multiple shapes in the area directly above the adhesive 30 and liner 40 to form stickers 28. Die-cut 26 includes knife cut, micro-perforation or any similar cut. This method provides an entertainment placemat product having an entertainment theme with related reusable die-cut stickers that are removable from their manufactured location for applying as desired onto the main pre-printed play or theme sanitary placemat portion 12.

To form the built-in storage pocket, a permanent adhesive 58 is applied in a specified but adjustable pattern on the back side 16 of the first single paper ply 70 as shown in FIG. 2. Then the second single paper ply 60 is collated or married onto the back 16 of the first single paper ply 70. The permanent adhesive 58 pattern, preferably applied in a block-u shape around the perimeter, bonds the two single paper plies 60 and 70 together creating a pocket for the storage of related supply items or other associated items listed above. Second single paper ply 60 would commonly include a double sided pressure sensitive tape or a line of remoistenable adhesive 56 which creates a section that can be folded along fold line 54 and sealed shut to ensure that these related supply or associated items stay inside the pocket. Optional construction would have a preprinted theme where the pocket area is used to facilitate the communication of return mailing or registration for club promotions, etc.

Additional perforations 52 next to the sealing tape or adhesive 56 allow the customer to easily tear off the sealed stub. Removing the sealed stub opens up the pocket and reveals the related supply items. This type of stub design allows for the secure storage of materials and easy access by the customer. Obviously, the entire pocket and product can be made bigger to hold different sized products. Additionally, multiple pockets can be formed and the placement of the pocket(s) can be varied. Preferably, the above listed materials, particularly the ink used for pre-printing the sanitary placemat portion, comply with FDA recommendations for products intended to be used with food.

Alternatively, the second single paper ply 60 may extend into the sticker portion 20 and may be coated with a release coating such as a silicone coating on the part extending into the sticker portion 20. In this construction, the second ply 60 provides the release liner for easy removal of the stickers 28. This option eliminates the need for an additional silicone coated substrate and eliminates the need to apply this release material in a subsequent manufacturing operation.

Figure 3:
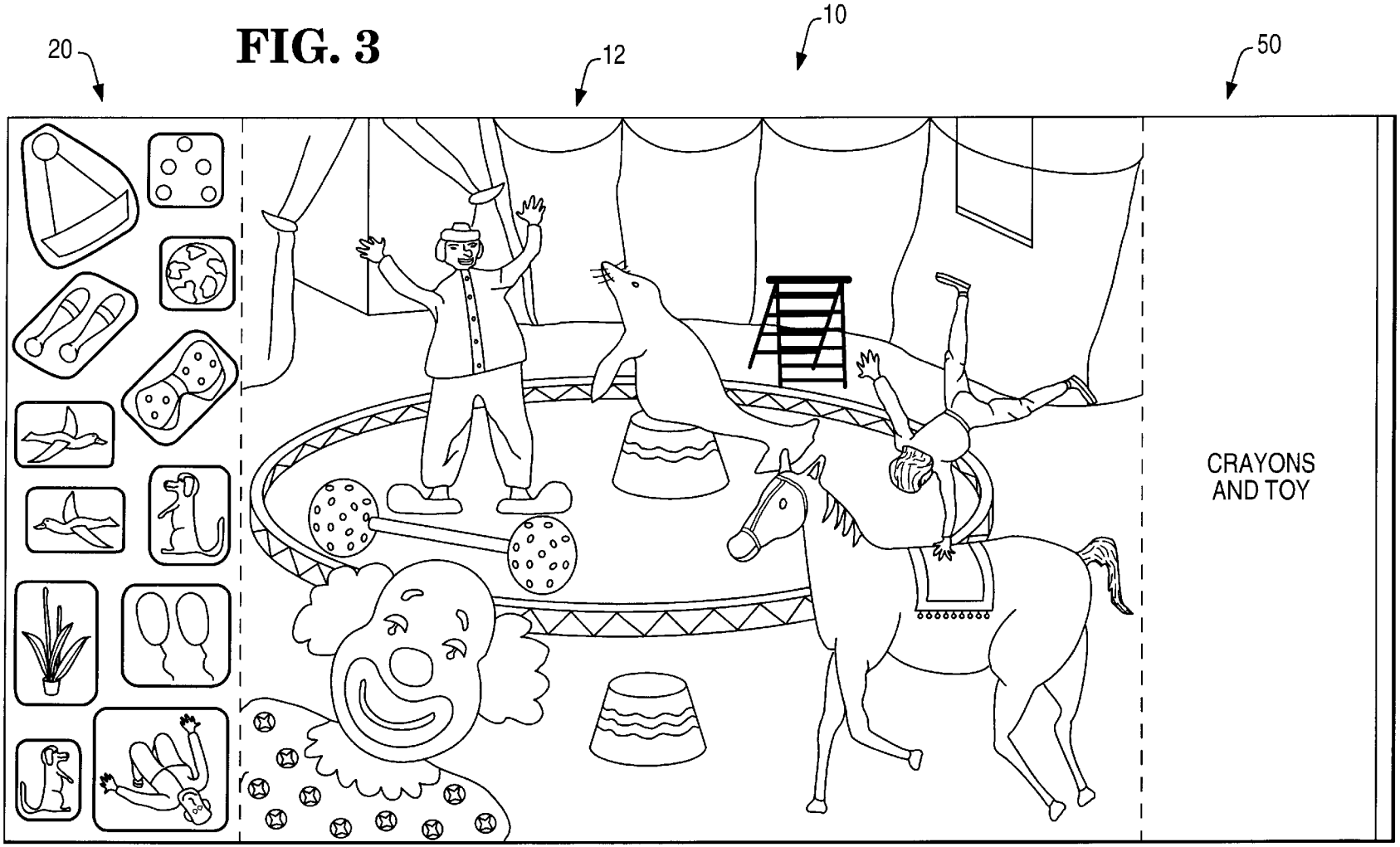
FIG. 3 shows a placemat product having a built-in storage pocket and having a circus theme preprinted thereon in accordance with the present invention.

FIG. 3 shows a placemat product having a built-in storage pocket and having a circus theme preprinted thereon in accordance with the present invention. The built-in storage pocket 50 is indicated to include crayons and a toy.

To use the customized entertainment placemat product of the present invention, the customer places the customized entertainment placemat product 10 on an eating surface, such as a tabletop or a food tray. Food in a container, a disposable wrap or the like or with no container at all may be placed on the sanitary placemat portion 12 of the customized entertainment placemat product.

The customer selects and removes associated items from the built-in pocket portion 50 of the customized entertainment placemat product. Associated items such as crayons or markers may be used to complete or enhance the pre-printed information in the sanitary placemat portion or indicia of the sticker portion of the placemat product to provide additional entertainment to the customer, preferably before the meal or other desired service arrives. Other associated items may include a toy or a membership card for a frequent diner club to provide additional entertainment to the customer. Additionally associated items may include snacks such as crackers or pretzels to entertain the customer before the meal or other desired service arrives. Generally, anything which a restaurant or other business desires to provide its customers but does not desire to handle separately, can be provided in the built-in pocket portion of the placemat product. Instructions on the product describe correct usage.

The customer also selects and removes any desired stickers from the sticker portion 20 of the customized entertainment placemat product. The customer then applies the stickers to the sanitary placemat portion 12 in any desired location. To provide continued entertainment and enjoyment, the customer may remove the stickers from the sanitary placemat portion 12 and reapply them to new locations to complete or enhance the preprinted entertainment theme of the sanitary placemat portion.

The stickers may be placed in any location the customer desires and are not intended to provide instruction or complete missing information such as labels on a business form are. The function of the stickers is to provide entertainment to the customer by allowing the customer to choose a location to place the sticker based solely on where the customer desires to place the sticker. If the removable stickers are inappropriately applied to other places such as the food container or the food tray, the stickers are easily removed by hand since they come loose in the water or other cleaning liquids used to clean such places, allowing for easy and fast clean-up.

Throughout this specification and the claims that follow, the term customer is used in a general sense to include any user of the placemat product, such as business customers, business employees or other interested persons, most particularly children.

Additionally, customized information may be provided by the business on any portion of the entertainment placemat product. This information may include special menus or other promotions or site specific information.

Advantageously, the placemat product of the present invention includes a built-in storage pocket to provide the multiple functions of a sanitary placemat, an entertainment device to occupy children and a storage pocket to hold related items in one comprehensive product.

Although the built-in storage pocket portion has been shown at the right of the sanitary placemat portion and the sticker portion has been shown at the left of the sanitary placemat portion, it is contemplated that any alignment of the portions be within the scope of this invention. Additionally, the size, configuration, and the number of pockets may be varied.

It is preferred that the placemat product with built-in storage pocket be constructed to have a standard overall dimension such as eight and one-half inches by eleven inches or eight and one-half inches by fourteen inches so it may be easily fed into a laser, inkjet, or other standard printer to enable the placemat product to be customized at the business site.

Additionally, it is contemplated that the stickers can be formed by other means such as applying transfer tape to the back of the first paper ply and then die-cutting, knife-cutting or using other known cutting means to form the stickers.

Additionally, when forming the built-in pocket portion 50, first single paper ply 70 can be long enough to fold, forming both sides of the pocket and having the permanent adhesive applied between the folded parts of first single paper ply 70. This eliminates the need to provide second single paper ply 60. Alternative known methods of forming an envelope or pocket from paper are contemplated for use in the present invention.

Although the invention has been described with particular reference to certain preferred embodiments thereof, variations and modifications of the present invention can be effected within the spirit and scope of the following claims.

What is claimed is:

1. A method of using a paper placemat product for customer entertainment comprising the steps of:

obtaining the paper placemat product having a sanitary paper placemat portion, a paper sticker portion including die-cut stickers and a built-in paper storage pocket portion wherein the built-in storage pocket portion includes a sealer enabling the built-in storage pocket portion to be sealed with related supply items or associated entertainment items contained therein, the paper placement product formed of a paper material suitable for and sized to fit through a standard printer for printing customized indicia on any of the portions of the placement product;

sealing shut in said storage pocket portion one of said items;

removing said one item from the sealed built-in storage pocket portion of the paper placement product;

selecting and removing stickers from the sticker portion of the paper placemat product; and applying the stickers to the sanitary placemat portion at locations desired by the customer to provide entertainment for the customer.

2. The method of claim 1 further including the step of placing the placemat product on an eating surface.

3. The method of claim 1 further including the step of placing food on the sanitary placemat portion of the placement product.

4. The method of claim 1 further including the step of using the removed associated item on the sanitary placemat portion of the placemat product to further entertain the customer before the meal or other desired service arrives.

5. The method of claim 1 further including the step of using the built-in storage pocket as a removable unit to carry a reusable entertainment item or as a mail-in container for associated registration.

6. The method of claim 1 wherein the placemat product further comprises:

said sanitary placemat portion including a pre-printed entertainment theme on a front surface;

said sticker portion including die-cuts surrounding pre-printed indicia associated with the pre-printed entertainment theme of the sanitary placemat portion forming removable stickers; and wherein said sanitary placemat portion, said sticker portion and said storage pocket portion are formed from two single plies of paper.

7. The method of claim 1 wherein the removable stickers are easily removable by hand or using cleaning liquids when the removable stickers are placed in any location the customer desires.

8. The method of claim 1 wherein said storage pocket portion includes a pattern of permanent adhesive on three sides of the pocket and a pattern of remoistenable or removable adhesive defining said sealer on a fourth side of the pocket.

9. The method of claim 6 wherein said storage pocket portion is a carrying container or a mail-in container to facilitate customer registration.

10. A method of using a paper placemat product for customer entertainment comprising the steps of:

obtaining the paper placemat product having a sanitary paper placemat portion including a pre-printed entertainment theme on a front surface, a paper sticker portion including die-cuts surrounding pre-printed indicia associated with the pre-printed entertainment theme of the sanitary placemat portion forming removable stickers; and a sealed shut built-in paper storage pocket portion storing an associated entertainment item to be used with the sanitary placemat portion, the paper placement product formed of a paper material suitable for and sized to fit through a standard printer for printing customized indicia on any of the portions of the placement product;

removing said item from the sealed built-in storage pocket portion of the customized entertainment paper placement product and using the associated entertainment item with the sanitary placemat portion before the meal or other desired service arrives;

selecting and removing stickers from the sticker portion of the paper placemat product; and applying the stickers to the sanitary placemat portion at locations desired by the customer to provide entertainment for the customer.

11. The method of claim 10 wherein said storage pocket portion is a carrying container or a mail-in container to facilitate customer registration.

12. A method according to claim 1 wherein said placemat product further includes a flap containing said adhesive sealer thereon next to an open end of said storage pocket portion, and said flap is folded over said pocket open end to seal shut said pocket portion.

13. A method according to claim 12 wherein said placemat product further includes a line of perforations next to said adhesive sealer, and said sealed shut flap is torn at said perforations to re-open said pocket portion.

14. A placemat product comprising:

a sanitary placemat portion including a pre-printed entertainment theme on a front surface of a first ply of paper;

a sticker portion including die-cuts in said first paper ply surrounding a pre-printed indicia associated with the pre-printed entertainment theme of the sanitary placemat portion forming removable stickers;

a second ply of paper adhesively bonded to a back surface of said first paper ply to define a storage pocket portion for storing items to be used with the sanitary placemat portion; and an adhesive sealer adjoining said storage pocket portion for sealing shut said storage pocket portion.

15. The placemat product of claim 14 wherein the placemat product is sized to fit into a standard printer for printing customized indicia on any of the portions of the placemat product.

16. The placemat product of claim 14 wherein the removable stickers are easily removable by hand or using cleaning liquids when the removable stickers are placed in any location the customer desires.

17. The placemat product of claim 14 wherein said storage pocket portion includes a pattern of permanent adhesive on three sides of the pocket and a pattern of remoistenable or removable adhesive defining said sealer on a fourth side of the pocket.

18. A method of making a placemat product with a storage pocket comprising:

providing a first ply of paper including a sticker portion having die-cut stickers;

preprinting a portion of said first ply of paper with an entertainment theme to provide a sanitary placemat portion, using materials which are acceptable for use in proximity to food;

applying a permanent adhesive in a u-shaped pattern to a portion of said first ply of paper outside of the portion with the entertainment theme preprinted thereon;

providing a second ply of paper;

placing said second ply of paper on the u-shaped pattern of permanent adhesive to form a storage pocket; and applying a remoistenable adhesive or pressure sensitive tape to a portion of the second ply of paper near the open end of the u-shaped pattern of the permanent adhesive to define a sealer for sealing shut said storage pocket.

19. The method of claim 18 further comprising providing a stub perforation next to said sealer to enable easy opening of the storage pocket after being sealed shut.

20. A method of making said placemat product according to claim 14 comprising:

providing a first ply of paper;

preprinting a portion of said first ply of paper with an entertainment theme to provide a sanitary placemat portion, using materials which are acceptable for use in proximity to food;

die cutting another portion of said first ply of paper to define said die-cut stickers;

applying a permanent adhesive in a u-shaped pattern to a portion of said first ply of paper outside of the portion with the entertainment theme preprinted thereon;

providing a second ply of paper;

placing said second ply of paper on the u-shaped pattern of permanent adhesive to form a storage pocket; and applying a remoistenable adhesive or pressure sensitive tape to a portion of the second ply of paper near the open end of the u-shaped pattern of the permanent adhesive to define a sealer for sealing shut said storage pocket.

* * * * *

UNITED STATES PATENT AND TRADEMARK OFFICE

CERTIFICATE OF CORRECTION

PATENT NO. : 6,258,428 B1
DATED : July 10, 2001
INVENTOR(S) : Richard L. Phillips et al.

It is certified that error appears in the above-identified patent and that said Letters Patent is hereby corrected as shown below:

Title page,
Item [54], "PLACEMENT" should be -- PLACEMAT --.

Column 6,
Line 10, delete "ment" and insert -- mat --.

Signed and Sealed this

Seventh Day of May, 2002

*Attest:*

*Attesting Officer*

JAMES E. ROGAN
*Director of the United States Patent and Trademark Office*